US008657461B2

(12) United States Patent
Allsop et al.

(10) Patent No.: US 8,657,461 B2
(45) **Date of Patent: *Feb. 25, 2014**

(54) SOLAR-POWERED COLLAPSIBLE LIGHTING APPARATUS

(75) Inventors: James D. Allsop, Bellingham, WA (US); Jamey J. Allsop, Ketchum, ID (US)

(73) Assignee: Allsop, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/468,827

(22) Filed: May 10, 2012

(65) Prior Publication Data

US 2012/0281393 A1 Nov. 8, 2012

Related U.S. Application Data

(63) Continuation of application No. 12/405,893, filed on Mar. 17, 2009, now Pat. No. 8,192,044, which is a continuation of application No. 11/671,359, filed on Feb. 5, 2007, now Pat. No. 7,513,638.

(60) Provisional application No. 60/765,762, filed on Feb. 6, 2006.

(51) Int. Cl.

| | |
|---|---|
| ***F21L 4/00*** | (2006.01) |
| ***F21V 1/06*** | (2006.01) |
| ***F21V 17/06*** | (2006.01) |

(52) U.S. Cl.

USPC ..... 362/183; 362/186; 362/352; 362/450

(58) Field of Classification Search

USPC ..... 362/183, 185, 186, 352, 355, 356, 357, 362/450; 320/101; 323/906

See application file for complete search history.

(56) References Cited

U.S. PATENT DOCUMENTS

| | | | | |
|---|---|---|---|---|
| 3,275,815 | A * | 9/1966 | Golaz et al. | 362/577 |
| 5,791,773 | A * | 8/1998 | Babineaux | 362/352 |
| 6,604,844 | B2 * | 8/2003 | Hussey | 362/341 |
| 6,840,657 | B2 * | 1/2005 | Tung | 362/352 |
| 7,073,919 | B1 * | 7/2006 | Masina | 362/153.1 |
| 7,264,380 | B1 * | 9/2007 | Monroe et al. | 362/352 |
| 7,311,414 | B2 * | 12/2007 | Norton et al. | 362/122 |
| 7,431,470 | B2 * | 10/2008 | Coleiro | 362/102 |
| 7,513,638 | B2 * | 4/2009 | Allsop et al. | 362/183 |
| 8,192,044 | B2 * | 6/2012 | Allsop et al. | 362/183 |
| 2005/0247334 | A1 * | 11/2005 | Erickson | 135/33.2 |
| 2005/0279403 | A1 * | 12/2005 | Kube | 136/291 |
| 2006/0109647 | A1 * | 5/2006 | Liu | 362/183 |

* cited by examiner

*Primary Examiner* — Alan Cariaso

(74) *Attorney, Agent, or Firm* — Lowe Graham Jones PLLC

(57) ABSTRACT

A solar-powered lighting apparatus having a light transmissible shade coupled to a housing that receives a solar cell, a battery and at least a portion of a lighting element assembly. In one embodiment, the shade may have a spherical shape achieved with a support unit or achieved by operation of gravity. A bottom device or bottom portion may be coupled to the shade and cooperate therewith forming and maintaining the spherical shape.

20 Claims, 6 Drawing Sheets

SOLAR-POWERED COLLAPSIBLE LIGHTING APPARATUS

PRIORITY CLAIM

This application is a continuation of U.S. application Ser. No. 12/405,893 filed Mar. 17, 2009, which a continuation of U.S. application Ser. No. 11/671,359 filed Feb. 5, 2007, which claims the benefit of provisional application Ser. No. 60/765,762, filed Feb. 6, 2006, each of which is hereby incorporated by reference.

FIELD OF INVENTION

This invention relates generally to lighting apparatus, and more specifically, to a solar-powered collapsible lighting apparatus

BACKGROUND OF INVENTION

Lighting can provide an important accent to any home, yard or garden. Among the many different types of lighting currently available are hanging lanterns such as those commonly known as Asian hanging lanterns. These lanterns are typically powered using traditional light and power sources, such as incandescent lamps powered by a home's electrical system, which limits the locations where the lanterns can be located. These lanterns can also be quite large and therefore expensive and burdensome to ship, transport and store. Thus, there exists a need to provide alternative power sources for these lanterns in order to allow for more flexibility in lantern placement. There also exists a need for lanterns which may be more easily and inexpensively shipped, transported and stored.

SUMMARY OF INVENTION

A solar-powered collapsible lighting apparatus and methods of assembling such a lighting apparatus are disclosed.

In one embodiment of the present invention, the solar-powered collapsible lighting apparatus comprises a lighting element assembly having a lighting element, a solar cell, a battery unit electrically coupled to the solar cell and to the lighting element assembly and a collapsible shade, wherein the solar cell is positioned proximate to the top of the collapsible shade and the lighting element assembly and the battery unit are positioned anywhere within the collapsible shade. The lighting element assembly can utilize different light sources, for example, light emitting diodes (LED's) or low voltage incandescent light bulbs. The solar cell can use one or more solar panels, with the number used being selected based on the power requirements of the system. The battery unit can use one or more rechargeable batteries, with the number used also being selected based on the power requirements of the system. The collapsible shade of the solar-powered collapsible lighting apparatus is positioned over the lighting element assembly to achieve a desired lighting effect. In another embodiment, the collapsible shade of the solar-powered collapsible lighting apparatus contains an opening located at the top of the shade and an opening located at the bottom of the shade. In this embodiment, a support unit which comprises a top portion positioned within or proximate to the opening located at the top of the shade, a bottom portion positioned within or proximate to the opening located at the bottom of the shade and a connecting device which connects the top portion of the support unit and the bottom portion of the support unit is located within the shade. In an alternate embodiment of the solar-powered collapsible lighting apparatus, the lighting element of the lighting element assembly is located between the bottom portion of the support unit and the top portion of the support unit and is separate from the solar cell. In an additional embodiment of the solar-powered collapsible lighting apparatus, the top portion of the support unit serves as a housing for the lighting element assembly, the solar cell and the battery unit. In another embodiment, the solar-powered collapsible lighting apparatus contains a hanging device for hanging the lighting assembly.

Also provided are methods for assembling a solar-powered collapsible lighting apparatus. In one embodiment, a method for assembling a solar-powered collapsible lighting apparatus comprises: providing a collapsible shade that contains an opening located at the top of the collapsible shade and an opening located at the bottom of the collapsible shade in its collapsed state; providing a support unit having a bottom portion, a connecting device and a top portion which houses a solar cell, a battery unit and a lighting element assembly; providing a hanging device; allowing the collapsible shade to expand to its deployed shape; assembling the support unit by connecting the top portion to the bottom portion using the connecting device; positioning the support unit within the deployed collapsible shade such that the top portion is positioned within or proximate to the opening located at the top of the collapsible shade and the bottom portion is positioned within or proximate to the opening located at the bottom of the collapsible shade; and attaching the hanging device to the top portion of the support unit.

As will be readily appreciated from the foregoing summary, the invention provides a solar-powered collapsible lighting apparatus with a number of notable advantages, including ease of shipment, transport and storage and flexibility in placement in a home, yard or garden setting.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

Figure 1:
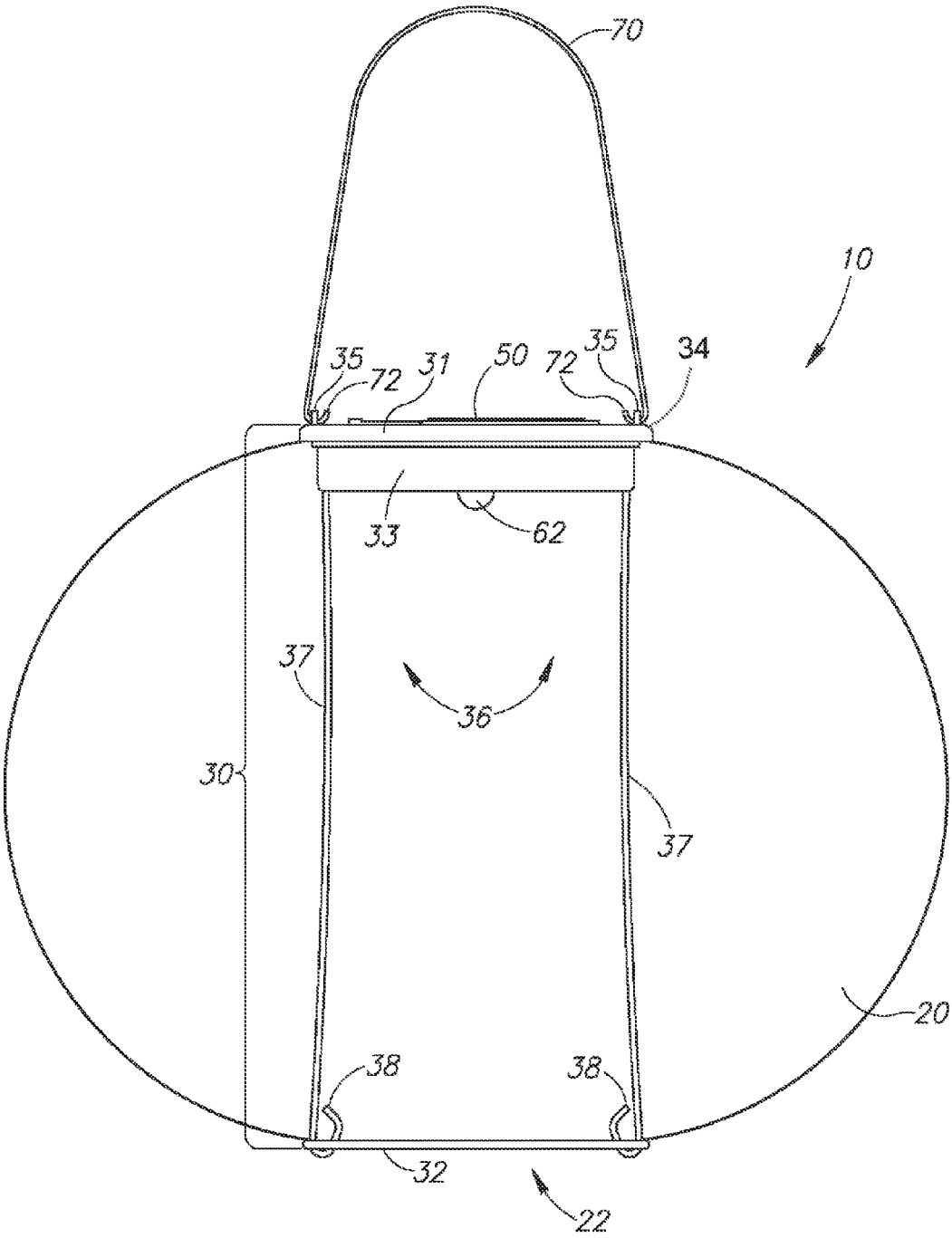
FIG. 1 is a perspective view of a solar-powered collapsible lighting apparatus, in accordance with the present invention.

Referring now to FIG. 1, an embodiment of a solar-powered collapsible lighting apparatus 10 is shown that has a collapsible shade 20 and a support unit 30 having a bottom portion 32, a top portion 34 and a connecting device 36 which connects the bottom portion 32 and the top portion 34. The connecting device 36 in the illustrated embodiment is comprised of two connecting rods 37 fabricated from tension wire and having hooked bottom ends 38 which are inserted into apertures in the bottom portion 32 of the support unit 30. However the connecting rods 37 can also be fabricated from other materials such as aluminum and rigid, weather-resistant plastics such as polycarbonate, polypropylene, or polyvinylchloride. The top ends of the connecting rods 37 are inserted into cavities in the top portion 34 of the support unit 30. The top portion of the support unit 30 includes an upper section 31 secured to a lower section 33. The top portion 34 of the support unit also includes a space for an optional light sensor and appendages 35 for connecting a hanging device 70. The bottom portion 32 of the support unit 30 is positioned within or proximate to an opening 22 located at the bottom of the collapsible shade 20 while the top portion 34 of the support unit 30 is positioned within an opening in the top portion of the collapsible shade 20. In the illustrated embodiment, the top portion 34 of the support unit 30 is used to house a lighting element assembly, a solar cell 50 and a battery unit; a lighting element cover 62 for the lighting element assembly is shown. The lighting element cover 62 can serve various functions. For example, the lighting element cover 62 can be used as a lens to focus light in a particular direction, such as downward to illuminate a sidewalk, or as a filter to selectively allow light through in order to produce a light pattern. The lighting element cover 62 can also be used as a light diffuser, in which case it typically serves to scatter light from the lighting element. One or both of the interior and exterior surfaces of the lighting element cover 62 may be colored, textured, or treated to enhance its focusing, filtering or diffusing properties. In one embodiment, the lighting element 62 is formed of cracked glass so as to act as a diffuser. Cracked glass provides the advantage of concentrating light from the lighting element at many fine cracks formed in the glass, creating a stunning visual effect while maximizing visibility. The solar cell 50 can use one or more solar panels, with the number used being selected based on the power requirements of the system. In the illustrated embodiment, a hanging device 70 having hooked ends 72 for connecting to the top portion 34 of the support unit 30 is shown. The hanging device 70 can be a rounded metal handle or a wire or any other device suitable for hanging the solar-powered collapsible lighting apparatus. However, it should be understood that for certain applications, such as placement on a table, a hanging device 70 is not required.

The collapsible shade 20 is typically comprised of a collapsible material which allows the partial or complete transmission of light through it and a collapsible frame which imparts a predetermined shape to the collapsible material. However, it should be understood that in some applications, the collapsible material itself can form the desired predetermined shape when deployed so that a collapsible frame is not required. The collapsible shade 20 can be made in various sizes. Typical collapsible materials include various types of paper, nylon, fabric or plastic and the like. For outdoor applications, it is desirable that the collapsible material be waterproof or water-resistant. The collapsible frame can be fabricated from materials such as plastic or metal. Although the collapsible shade 20 shown in the illustrated embodiment is a globe, such as in an Asian lantern, the collapsible shade 20 can be different three-dimensional shapes, for example, a box, a star or a shape similar to that of a hot air balloon. If desired, the collapsible material can be colored, textured, printed or embossed with a graphic design or otherwise treated to achieve a particular lighting effect.

The solar-powered collapsible lighting apparatus can optionally include a light sensor and a switch 61 electrically interposed between the battery unit 80 and the lighting element assembly 60. The switch 61 is electrically coupled to the light sensor and is selectively opened and closed by the light sensor depending on the ambient lighting conditions.

Figure 2:
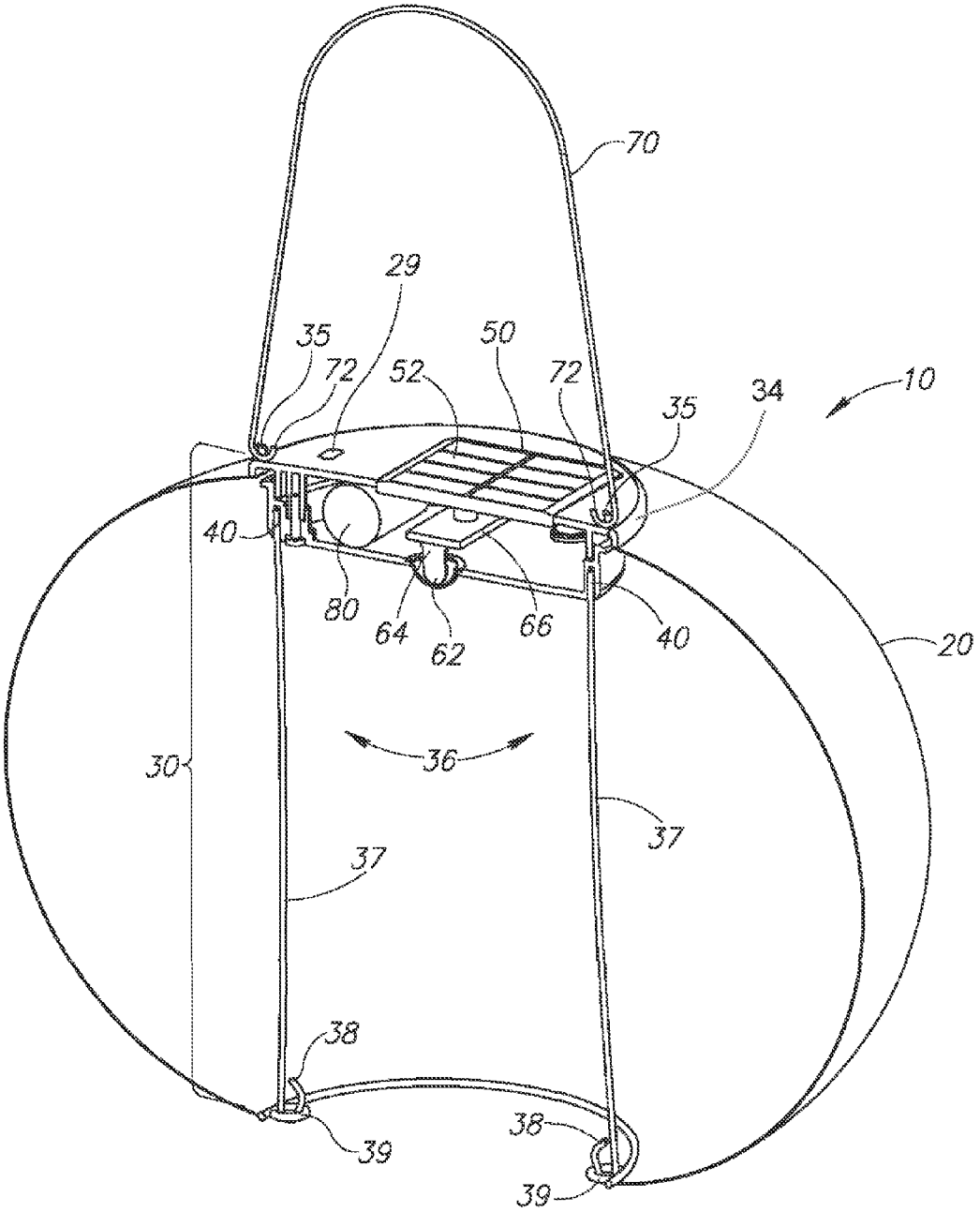
FIG. 2 is a cross-sectional view of a solar-powered collapsible lighting apparatus, in accordance with the present invention.

Referring now to FIG. 2, an embodiment of the solar-powered collapsible lighting apparatus is shown in cross-sectional view. As set forth above, the solar-powered collapsible lighting apparatus 10 includes: the collapsible shade 20 having the bottom opening 22 and the top opening; the support unit 30 having the bottom portion (not shown except for the apertures 39), the top portion 34 which has the upper section 31, the lower section 33, a space 29 for an optional light sensor and the appendages 35, and the connecting device 36 which has two connecting rods 37 with hooked bottom ends 38; and the hanging device 70 having hooked bottom ends 72. The top ends of the connecting rods 37 are inserted into cavities 40 in the top portion 34 of the support unit 30. In the illustrated embodiment, the top portion 34 of the support unit 30 is used to house a lighting element assembly 60, a solar cell 50 and a battery unit 80. The battery unit 80 is electrically coupled to the solar cell 50 and the lighting element assembly 60. The solar cell 50 as shown contains eight solar panels 52. The lighting element assembly as shown contains a lighting element cover 62, a lighting element 64 and a circuit board 66 for mounting the lighting element (e.g., an LED circuit board) and regulating the voltage passing to and from the battery unit 80 and to the lighting element assembly 60. Optionally, the circuit board 66 can also receive the output of a light sensor and turn on the lighting element assembly 60 when the output indicates low light levels and turn it off when the output indicates high light levels. The lighting element assembly 60 can utilize different lighting elements 64, for example, light emitting diodes (LED's) or low voltage incandescent light bulbs. The lighting element 64 can be various colors and, in the case of LED's, can be the color of any available LED's. In some embodiments, a phosphorescent coating over the LED results in light having wavelengths other than those output by the LED. The battery unit 80 can use one or more rechargeable batteries, with the number used being selected based on the power requirements of the system.

Figure 3:
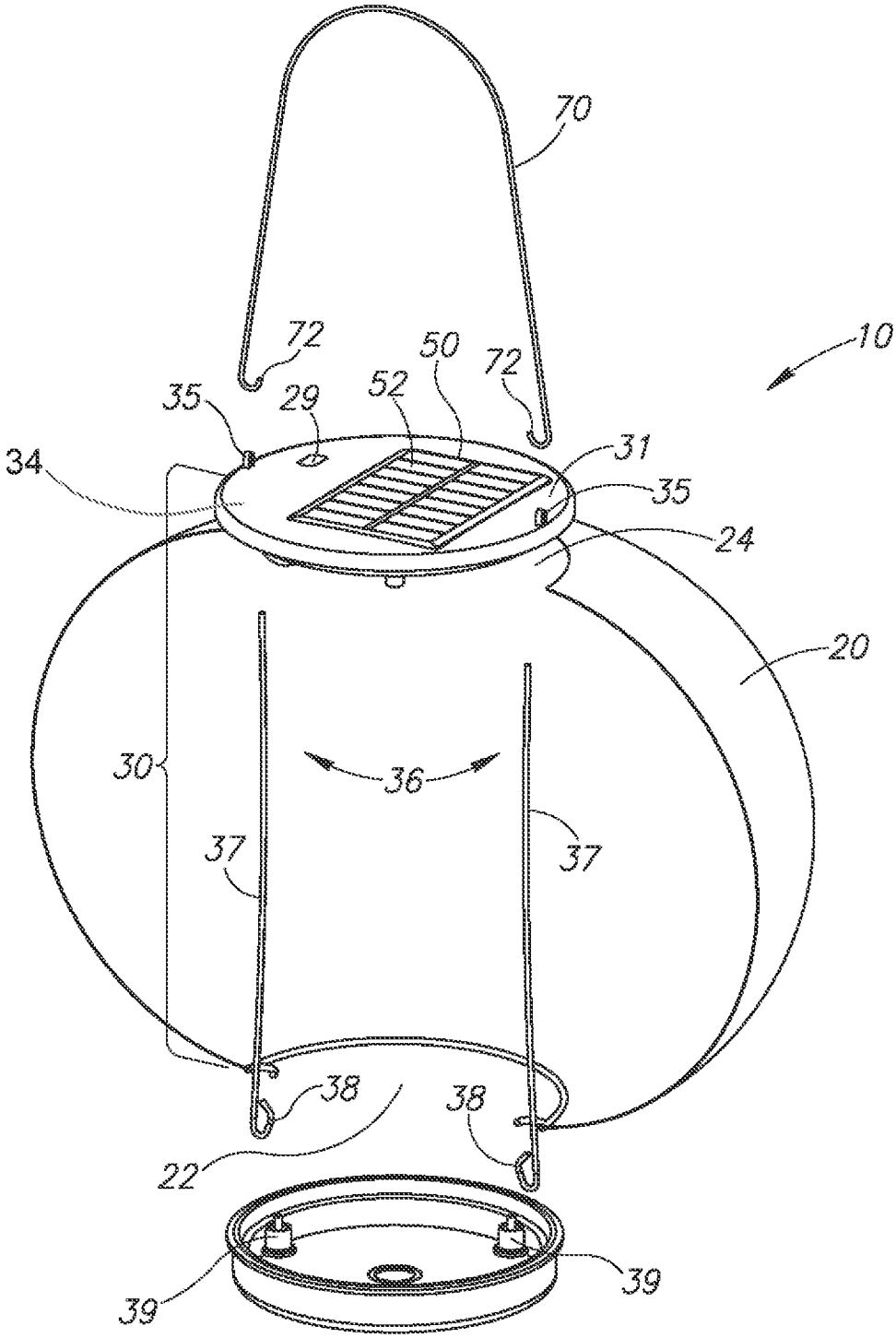
FIG. 3 is an exploded, cross-sectional view of a solar-powered collapsible lighting apparatus, in accordance with the present invention.

Referring now to FIG. 3, an embodiment of the solar-powered collapsible lighting apparatus is shown in an exploded, cross-sectional view. As set forth above, the solar-powered collapsible lighting apparatus 10 includes: the collapsible shade 20 having the bottom opening 22 and the top opening 24; the support unit 30 having the bottom portion 32 which has the apertures 39, the top portion (only upper section 31 shown) which has the space 29, the appendages 35 and the solar cell 50 having the solar panels 52 and the connecting device 36 which has the two connecting rods 37 with hooked bottom ends 38; and the hanging device 70 having hooked bottom ends 72. In general and as illustrated, the bottom opening 22 should be larger than the top opening 24 of the collapsible shade 20 in order to provide for proper positioning and alignment of the bottom portion 32 and the top portion 34 of the support unit 30. The sizes of the bottom opening 22 and top opening 24 of the collapsible shade 20 are selected based on the size of the solar cell 50, the lighting element assembly and the battery unit to be incorporated into the top portion 34 of the support unit 30.

It should be understood that, for ease of shipment, transport and storage, the solar-powered collapsible lighting apparatus 10 can be packaged unassembled and assembled when needed. In one embodiment of an assembly method, the collapsible shade 20, the support unit 30 and the hanging device 70 are provided unassembled. The collapsible shade 20 is allowed to expand to its deployed state. The support unit 30 is assembled by connecting the bottom portion 32 with the top portion 34 (which houses the solar cell, the battery unit and the lighting element assembly) using the connecting 36. The assembled support unit 30 is then positioned within the deployed collapsible shade 20 such that the top portion 34 is positioned within or proximate to the top opening of the collapsible shade 20 and the bottom portion 32 is positioned within or proximate to the bottom opening 24 of the collapsible shade. The hanging device 70 is then attached to the top portion 34 of the support unit 30.

Figure 4:
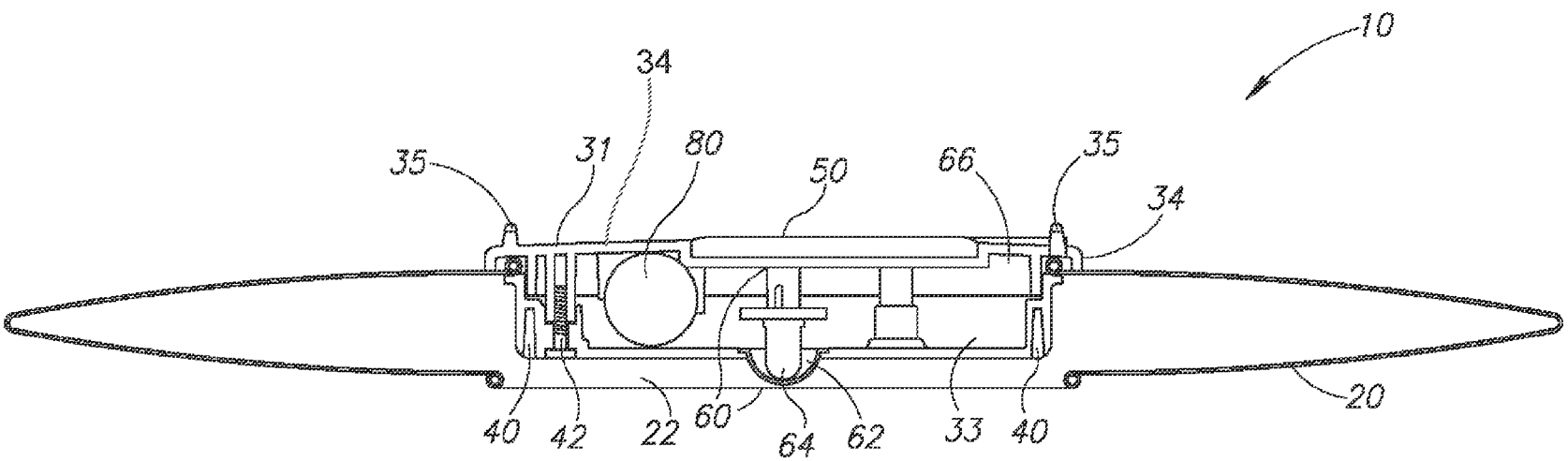
FIG. 4 is a cross-sectional view of a solar-powered collapsible lighting apparatus in the collapsed state, in accordance with the present invention.

Referring now to FIG. 4, an embodiment of the solar-powered collapsible lighting apparatus 10 in the collapsed state is shown in cross-sectional view. In this FIG. 4, only the collapsible shade 20 and the top portion 34 of the support unit of the solar-powered collapsible lighting apparatus 10 are shown. As set forth above, the collapsible shade 20 includes the bottom opening 22 and the top opening and the top portion 34 of the support unit includes the cavities 40 and the appendages 35 and is used to house the lighting element assembly 60, the solar cell 50 and the battery unit 80. The top portion 34 of the support unit includes the upper section 31 secured to the lower section 33 using a screw 42. The lighting element assembly 60 includes the lighting element cover 62, the lighting element 64 and the circuit board 66. In the collapsed state, the solar-powered collapsible lighting apparatus 10 is easily shipped, transported and stored. For maximum benefit, the solar-powered collapsible lighting apparatus 10 should be as thin as possible when in the collapsed state. In general, it is desirable that the solar-powered collapsible lighting apparatus 10 have a thickness no greater than about one inch when in the collapsed state.

Figure 5:
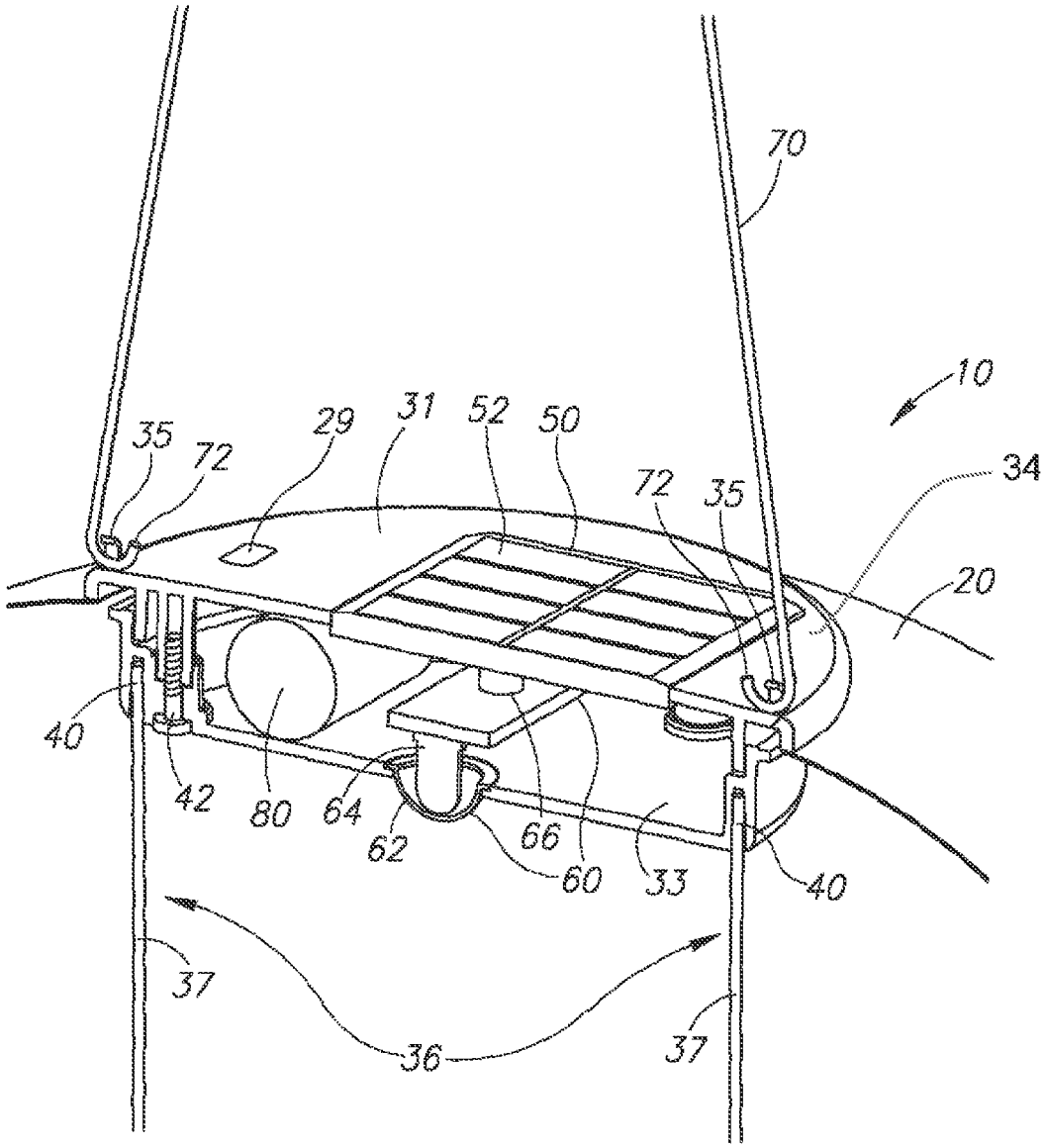
FIG. 5 is a cross-sectional view of an embodiment of the upper sector of a support unit of a solar-powered collapsible lighting apparatus, in accordance with the present invention.

Referring now to FIG. 5, the upper sector of an embodiment of the solar-powered collapsible lighting apparatus 10 is shown in cross-sectional view. In this FIG. 5, only the collapsible shade 20, the upper portion of the connecting device 36 which has two connecting rods 37, the lower portion of the hanging device 70 and the top portion 34 of the support unit of the solar-powered collapsible lighting apparatus 10 are shown. As set forth above, the collapsible shade 20 includes the top opening, the hanging device 70 includes the hooked bottom ends 72 and the top portion 34 of the support unit includes the upper section 31, the lower section 33, the space 29, the cavities 40, the screw 42 and the appendages 35 and is used to house the lighting element assembly 60, the solar cell 50 having the solar panels 52 and the battery unit 80. The lighting element assembly 60 includes the lighting element cover 62, the lighting element 64 and the circuit board 66.

Figure 6:
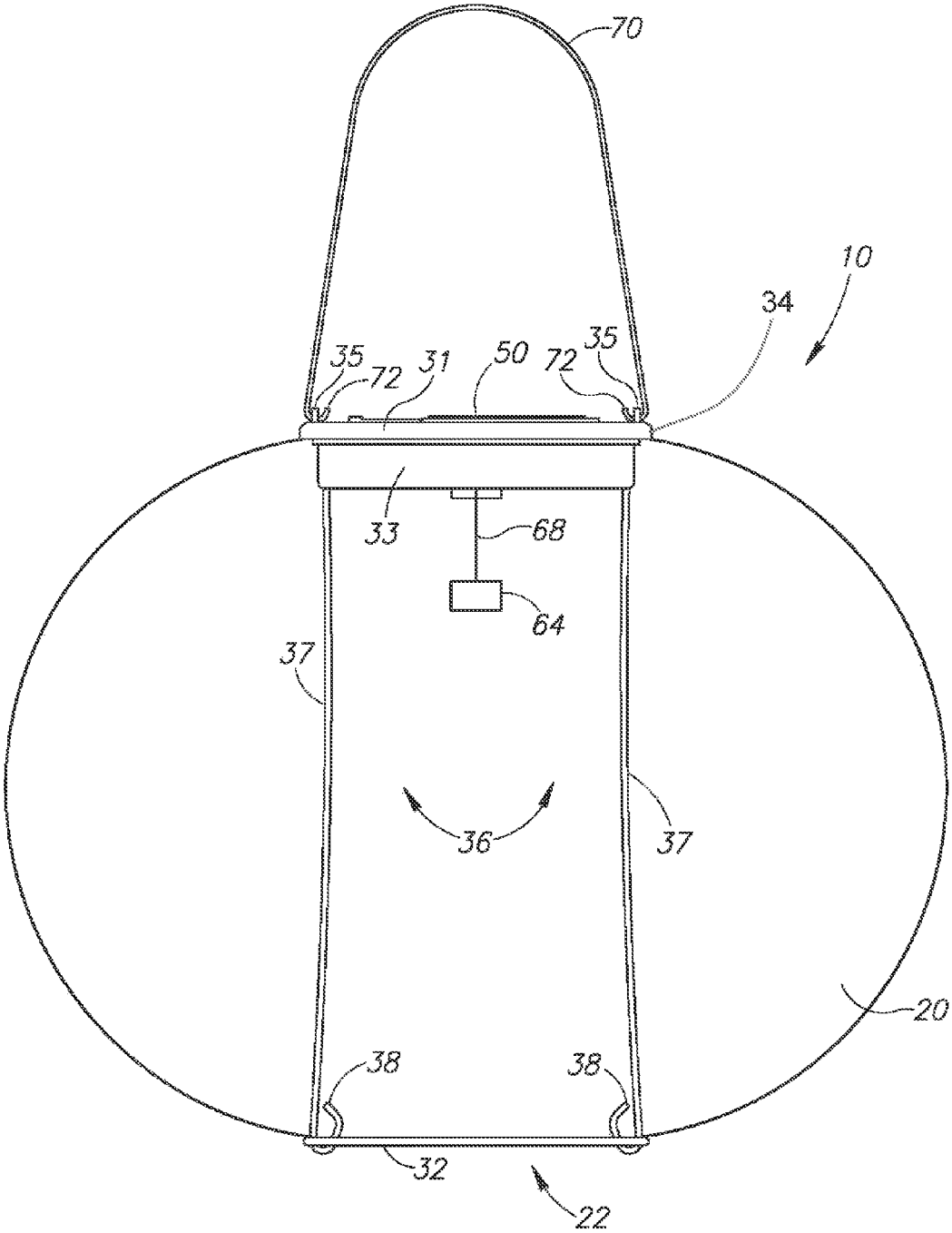
FIG. 6 is a perspective view of an alternate embodiment of a solar-powered collapsible lighting apparatus, in accordance with the present invention.

Referring now to FIG. 6, an alternate embodiment of the solar-powered collapsible lighting apparatus is shown in which the lighting element 64 is in a separate location from the solar cell 50. As set forth above, the solar-powered collapsible lighting apparatus 10 includes: the collapsible shade 20 having the bottom opening 22 and the top opening; the support unit 30 having the bottom portion 32, the top portion 34 which has the upper section 31, the lower section 33 and the appendages 35, and the connecting device 36 which has two connecting rods 37 with hooked bottom ends 38; and the hanging device 70 having hooked bottom ends 72. In the illustrated embodiment, the lighting element 64 is not in the top section along with the solar cell 50. Rather, the lighting element 64 is suspended from a wire 68 which electrically couples the lighting element 64 to the solar cell 50.

It will be understood that the present disclosure is not limited to the embodiments disclosed herein as such embodiments may vary somewhat. It is also to be understood that the terminology employed herein is used for the purpose of describing particular embodiments only and is not intended to be limiting in scope and that limitations are only provided by the appended claims and equivalents thereof.

What is claimed is:

1. A solar-powered collapsible lighting apparatus comprising:

a lighting element assembly that comprises a lighting element;

a solar cell;

a battery unit electrically coupled to the solar cell and to the lighting element assembly;

a collapsible shade that comprises an opening located at the top of the collapsible shade and an opening located at the bottom of the collapsible shade; and a support unit that comprises a top portion that houses the solar cell and the battery unit, a bottom portion positioned within or proximate to the opening located at the bottom of the collapsible shade and a connecting device that connects the top portion of the support unit and the bottom portion of the support unit, wherein the top portion of the support unit is secured to the opening located at the top of the collapsible shade when the collapsible shade is in both its collapsed state and its deployed state and at least a portion of the lighting element assembly is positioned below the opening at the top of the collapsible shade when the collapsible shade is in both its collapsed state and its deployed state.

2. The lighting apparatus of claim 1, wherein the lighting element of the lighting element assembly is located between the bottom portion of the support unit and the top portion of the support unit and is separate from and electrically coupled to the solar cell.

3. The lighting apparatus of claim 1, wherein the top portion of the support unit houses the lighting element assembly, the solar cell, and the battery unit.

4. The lighting apparatus of claim 1, wherein the collapsible shade comprises a collapsible material that allows the partial or complete transmission of light through it and a collapsible frame that imparts a predetermined shape to the collapsible material.

5. The lighting apparatus of claim 4, wherein the collapsible material is located over the collapsible frame.

6. The lighting apparatus of claim 4, wherein the collapsible frame is located within the collapsible material.

7. The lighting apparatus of claim 4, wherein the collapsible material is paper, nylon, fabric, or plastic.

8. The lighting apparatus of claim 4, wherein the collapsible material is waterproof or water-resistant.

9. The lighting apparatus of claim 4, wherein the collapsible frame is wire or plastic.

10. The lighting apparatus of claim 4, wherein the predetermined shape is a globe.

11. The lighting apparatus of claim 1, wherein the solar cell comprises one or more solar panels.

12. The lighting apparatus of claim 1, further comprising:

a light sensor; and a switch electrically interposed between the battery and lighting element assembly, the switch being electrically coupled to the light sensor to be selectively opened and closed thereby.

13. The lighting apparatus of claim 12, wherein the lighting element assembly further comprises a circuit board.

14. The lighting apparatus of claim 12, wherein the lighting element comprises one or more LED's electrically coupled to the battery.

15. A method for assembling a solar-powered collapsible lighting apparatus comprising:

providing a collapsible shade that contains an opening located at the top of the collapsible shade and an opening located at the bottom of the collapsible shade in its collapsed state;

providing a support unit having a bottom portion, a connecting device, and a top portion, wherein the top portion houses a solar cell, a battery unit, and a lighting element assembly; wherein the top portion of the support unit is positioned within and at least partially below the opening located at the top of the collapsible shade when the collapsible shade is in both its collapsed state and its deployed state;

providing a hanging device secured to the top portion of the support unit;

allowing the collapsible shade to expand to an at least partially deployed shape; and assembling the support unit by connecting the top portion to the bottom portion using the connecting device.

16. A solar-powered lighting apparatus comprising:

a lighting element assembly having a lighting element;

a solar cell;

a battery unit electrically coupled to the solar cell and to the lighting element assembly;

a housing having a first section coupled to the solar cell, said housing providing a compartment for receiving the battery unit, wherein the lighting element is positioned below a top of the housing and projects from the housing; and a collapsible shade including a frame defining a shade shape, the frame having an upper portion defining an opening, the upper portion of the frame being fastened to the housing, the frame being collapsible together with the shade, the upper portion of the shade remaining fastened to the housing when collapsed.

17. A solar-powered lighting apparatus comprising:

a lighting element assembly having a lighting element;

a solar cell;

a battery unit electrically coupled to the solar cell and to the lighting element assembly;

a housing having an first section coupled to the solar cell, said housing providing a compartment for receiving the battery unit, wherein the lighting element is positioned below a top of the housing; and a collapsible shade including a frame defining a shade shape, the frame having an upper portion defining an opening, the upper portion of the frame being fastened to the housing, wherein the housing includes upper and lower sections, the frame being directly clamped between the upper section and lower section of the housing.

18. The lighting apparatus of claim 16, wherein the shade includes paper, nylon, fabric, or plastic overlying the shade frame.

19. The lighting apparatus of claim 18, wherein the shade forms a globe shape.

20. A solar-powered lighting apparatus comprising:

a lighting element assembly having a lighting element;

a solar cell;

a housing having a portion for receiving the solar cell and an attachment for the lighting element; and a light-transmissible collapsible shade assembly comprising a frame supporting a deployed shade shape and a light-transmissible shade portion, the shade portion having an upper portion fastened to the housing, the frame being collapsible together with the shade, the upper portion of the shade remaining fastened to the housing when collapsed.

* * * * *